United States Patent [19]

Westra et al.

[11] 4,146,942

[45] Apr. 3, 1979

[54] PAPER PADDING OR TABLETING PRESS

[75] Inventors: Dan P. Westra; John Siewert, both of Grand Haven, Mich.

[73] Assignee: The Challenge Machinery Company, Grand Haven, Mich.

[21] Appl. No.: 862,819

[22] Filed: Dec. 21, 1977

[51] Int. Cl.[2] ..... B42C 19/00

[52] U.S. Cl. ..... 11/1 B; 100/219

[58] Field of Search ..... 11/1 B; 100/219

[56] References Cited

U.S. PATENT DOCUMENTS 3,986,447 10/1976 Zimmer ..... 11/1 B X

*Primary Examiner*—Travis S. McGehee

*Attorney, Agent, or Firm*—Price, Heneveld, Huizenga & Cooper

[57] ABSTRACT

A paper padding press is disclosed comprising a support base and a tiltable rack having stacking and working positions for aligning a stack of pads and gluing and edges of the pads, respectively. The tiltable rack includes a planar stacking table having a pair of upstanding posts disposed at a right angle to the stacking table. The upstanding tubular posts support a pair of guide doors providing a surface disposed at a right angle to the stacking table for aligning the edges of the pads to be glued. The upstanding tubular posts also support a clamp bar and a pair of pipe clamps for clamping a stack of pads between the stacking table and the clamp bar. Means are provided for securely latching the doors closed for the stacking operation and open to the side of the stacking table for the gluing operation. The tiltable rack is latched in a working position and gravity secured in a stacking position by a stop rod pivoted on the underside of the stacking table. One end of the stop rod is received in an aperture disposed in the support base below the stacking table. The opposite end of the stop rod includes a handle for operating the latch and changing the angular adjustment of the tiltable rack. The end of the stop rod received in the aperture includes shoulders which cooperating with various diameter openings in the aperture act to fix the tiltable table in stacking and working positions without interference with the pivoting guide doors, or limiting the work area behind the padding press.

20 Claims, 13 Drawing Figures

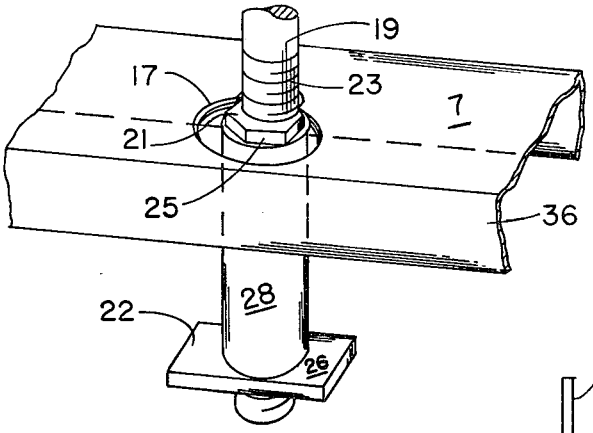
FIG. 5
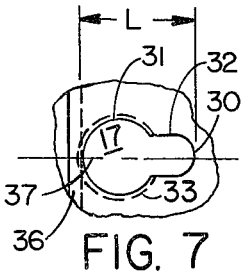
FIG. 7
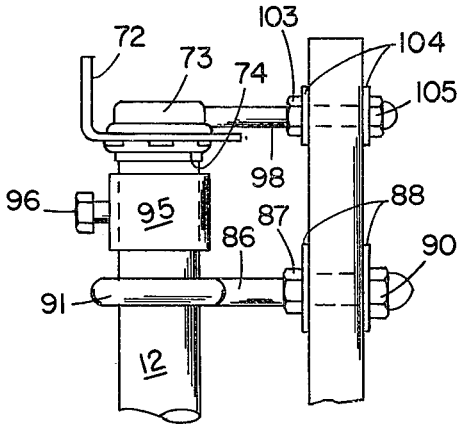
FIG. 10
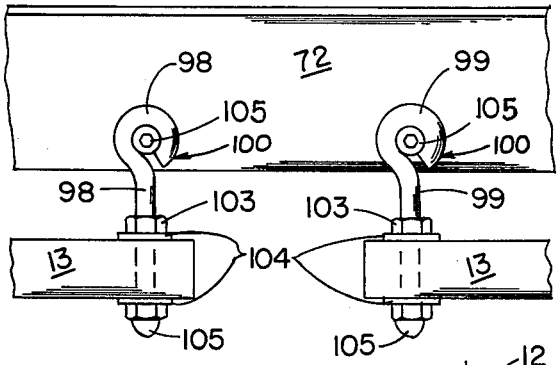
FIG. 11
FIG. 13
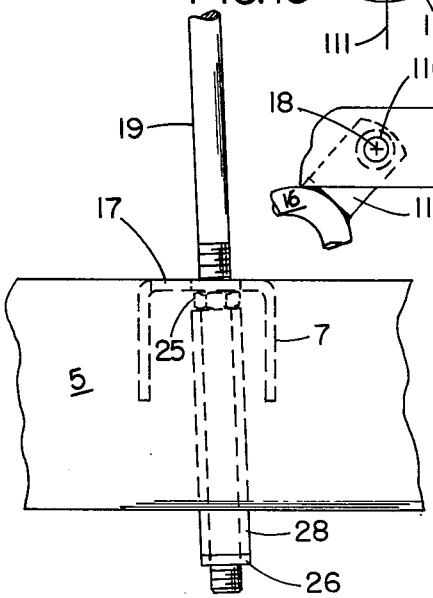
FIG. 6
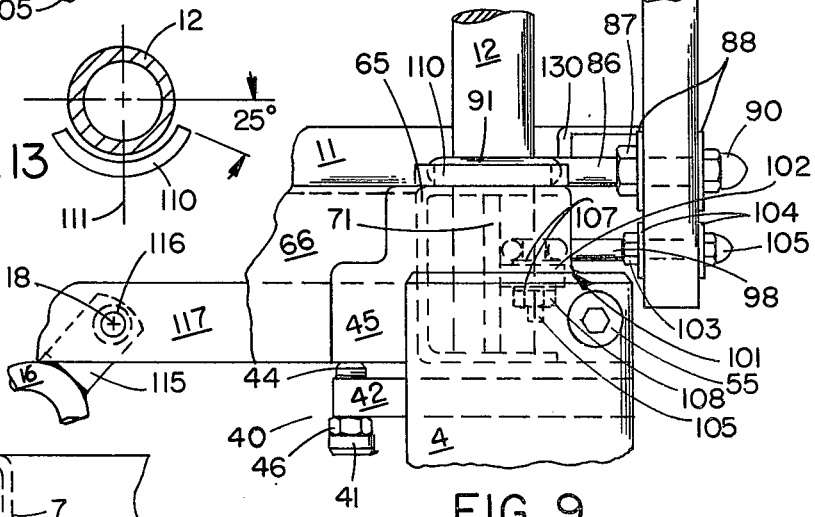
FIG. 9
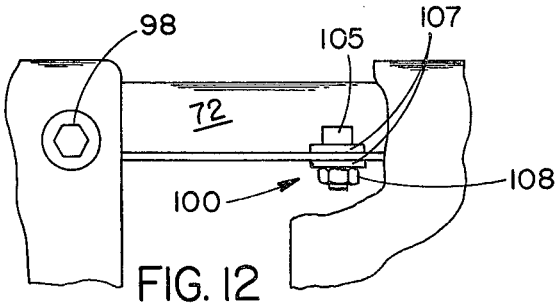
FIG. 12

PAPER PADDING OR TABLETING PRESS

BACKGROUND OF THE INVENTION

The invention relates to paper padding or tableting presses of the type that are normally used in print shops for binding the edges of a stack of papers by gluing.

Conventionally, padding presses of this type include a stationary base and a tiltable structure serving both as a stacking rack and a press. The tiltable structure generally includes a planar table and a backboard disposed at a right angle to the table. The backboard provides a padding surface on which the edges of the paper to be padded may be aligned by gravity. After the pads are securely clamped in position, the backboard may be removed, the table returned to a horizontal position, and the edges of the pads may be glued.

In the prior art, the tiltable structure of the padding press was often secured in both the tilted stacking position and the horizontal working position by gravity and the placement of the pivot point. This was found to be generally undesirable, since the tiltable press structure was not securely latched in either stacking or working positions and the structure was particularly unstable at working angles placing the stacking table near horizontal. Thus a variety of different arrangements for securing the tiltable structure of the padding press in stacking and working positions developed in the prior art. In some cases simple latching and/or prop structures were developed for securing the tiltable structure in various angular positions. However, these structures often limited the work area provided at the rear of the press for the gluing operation and complicated removal of the backboard. In other cases, rather complex and thus expensive, gearing arrangements were provided for securing the tiltable structure of the press in various angular orientations.

SUMMARY OF THE INVENTION

According to the present invention, a simple and thus less costly padding press is disclosed that is sturdy, easy to use, and provides secure latching in the working position without a latching means that limits the working area during the gluing operation or complicates backboard removal. The press comprises a support base and a tiltable rack including a stacking table and a pair of pivoting guide doors serving as a backboard. The tiltable rack includes a pair of upstanding tubular posts disposed at a right angle to the stacking table. The guide doors are pivoted from the upstanding posts by a first pair of eye bolts on each guide door. A clamp bar and a pair of pipe clamps vertically adjustable on the upstanding posts are provided to compress a stack of pads between the stacking table and the clamp bar.

The tiltable rack is latched in the generally horizontal work position and gravity secured in the tilted stacking position by a stop rod pivoted on the underside of the stacking table. One end of the stop rod is received in an aperture disposed in the support base below the stacking table. Shoulders on the end of the stop rod cooperate with various diameter openings in the aperture to fix the tiltable rack in stacking and working positions without limiting the work area for the gluing operation or interfering with the pivoting guide doors. The opposite end of the pivoted stop rod extends under the stacking table at approximately a right angle to the end of the stop rod received in the aperture and is provided with a handle for actuating the latch and changing the angular orientation of the tiltable rack.

The pivoting guide doors are also securely latched in both the closed and open positions. The guide doors are secured in the closed position by a second pair of eye bolts disposed on each guide door which cooperate with a pair of vertical latch posts disposed on the tiltable rack. The guide doors are secured in the closed position by pivoting and axial adjustment of the doors which pins the second pair of eye bolts over the vertical upstanding latch posts. The guide doors are secured in an open position at the sides of the stacking table by a pair of C-shaped stops disposed on the tiltable rack at the base of each upstanding tubular post. The C-shaped stops engage the shanks of the first set of eye bolts such that the guide doors must be simultaneously lifted and pivoted to cam the shanks over and behind the C-shaped stops where the stops secure the doors in the open position.

BRIEF DESCRIPTION OF THE DRAWINGS

FIG. 5 is a perspective of a portion of the means for latching the tiltable rack;

FIG. 6 is a side view of a portion of the means for latching the tiltable rack;

FIG. 7 is a top view of a portion of the means for latching the tiltable rack;

FIG. 9 is a side view of the pivot point for the tiltable rack;

FIG. 10 is a side view of the top of the tiltable rack;

FIG. 11 is a top view of a portion of the means for latching the guide doors closed;

FIG. 12 is a rear view of a portion of the means for latching the guide doors closed; and FIG. 13 is a top view of a portion of the means for latching the guide doors open.

DESCRIPTION OF THE PREFERRED EMBODIMENTS

Figure 3:
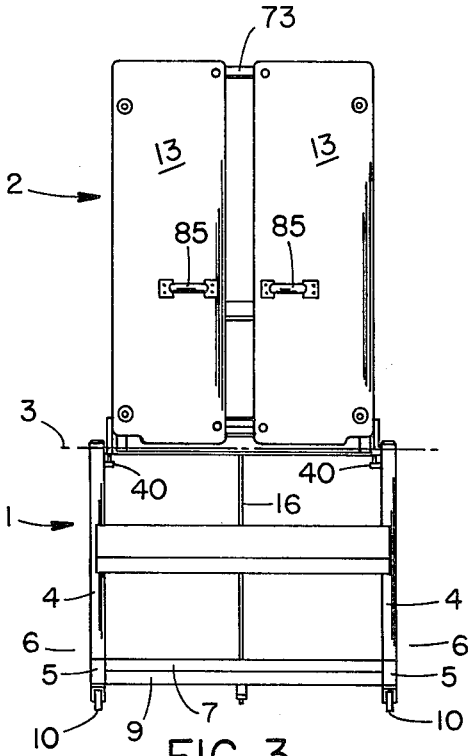
FIG. 3 is a rear elevation of the padding press of FIG. 1.

Referring to the drawings and in particular to FIGS. 1, 2, 3 and 4, the padding press of the present invention is illustrated. The padding press comprises a support base or stand 1 and a tiltable rack 2 pivotable about an axis 3 extending transversely through the stand 1. The stand 1 comprises a pair of vertical beams 4, welded to a pair of horizontal beams 5 to form two inverted T-shaped load supporting members 6 best illustrated in FIGS. 1 and 2. The beams 4 and 5 are preferably steel beams, box-shaped in cross section. The T-shaped load supporting members 6 form the sides of the stand 1 and they are interconnected by a transverse channel-shaped beam 7, work trays 8 and 9 and the tilting rack 2 which is journaled in the stand 1 about the axis 3. In addition to adding some transverse structural support, the horizontal trays 8 and 9 are provided to store supplies and tools necessary for the gluing operation. The stand 1 further includes a plurality of casters generally indicated by the numeral 10. The casters 10 are widely spaced on the beams 5 to lend stability to the padding press and still provide ease in handling.

The tiltable rack generally indicated by the numeral 2 comprises a planar stacking table 11 having a pair of upstanding tubular posts 12 disposed at a right angle to the stacking table 11. The tubular posts 12 support movable means for guiding a stack of pads, in the form of a pair of pivoting guide doors 13, and means for applying compression to a stack of pads, in the form of a pair of pipe clamps 14 and a clamp bar 15.

Figure 4:
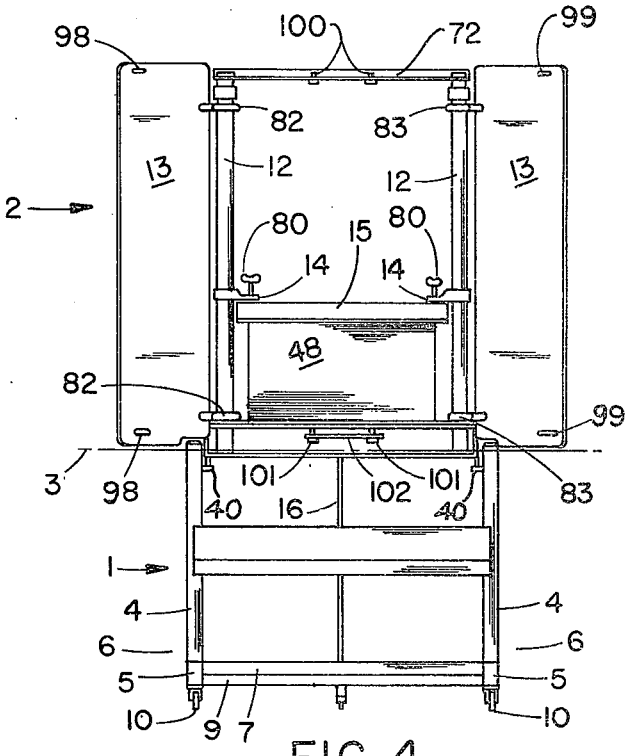
FIG. 4 is a rear elevation of the padding press of FIG. 1 with the guide doors open.
Figure 1:
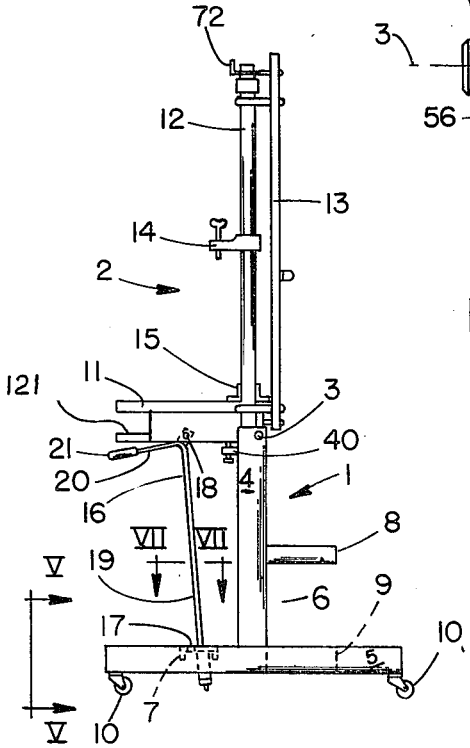
FIG. 1 is a side elevation of a padding press constructed according to the present invention with the tiltable rack in the working position and the guide doors closed.
Figure 2:
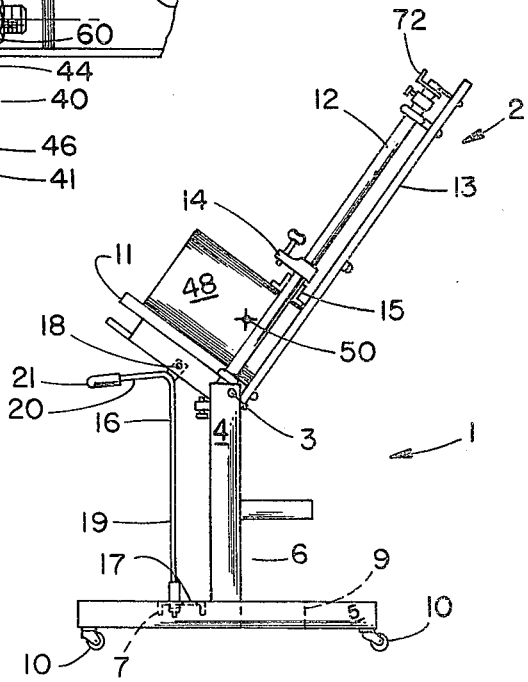
FIG. 2 is a side elevation of the padding press of FIG. 1 with the tiltable rack in the stacking position.

The padding press further includes means for latching the tiltable rack 2 in the horizontal working position illustrated in FIGS. 1, 3 and 4 and gravity securing the tiltable rack 2 in the tilted stacking position illustrated in FIG. 2. The means for latching the tiltable rack 2 comprises a stop rod 16 and an aperture disposed at 17 on the stand 1. The stop rod 16 is pivotable about a point 18 centered in the transverse direction on the underside of the stacking table 11. The stop rod 16 includes first and second ends 19 and 20, respectively. The first end 19 of the stop rod 16 extends to the aperture 17 disposed beneath the stacking table 11 and centered transversely on channel-shaped beam 7. Shoulders on the first end 19 of the stop rod 16 cooperate with the aperture 17 on the stand 1 to fix the tiltable rack 2 in the horizontal working position illustrated in FIG. 1 and the tilted or stacking position illustrated in FIG. 2. Latching and unlatching of the stop rod 16 is effected by lifting and pivoting the stop rod 16 by a handle 21 disposed on the second end 20 of the stop rod 16. The second end 20 of stop rod 16 is disposed at approximately a right angle to the first end 19 of the stop rod 16. Since the pivoting stop rod 16 and the aperture 17 are disposed below the stacking table 11, the latching means for the tiltable rack 2 does not interfere with the movement of the pivoting doors 13 nor does it limit the working area above the horizontal trays 8 and 9, behind the press.

Referring now to FIGS. 5 and 6, additional details of the first end 19 of the stop rod 16 and cooperating aperture 17 in the channel-shaped beam 7 are illustrated. The first end of the stop rod 19 includes first and second shoulders 21 and 22, respectively. The first end 19 of the stop rod is threaded as illustrated at 23 so that the first and second shoulders 21 and 22 may be formed by threading a hex nut 25 and weld nut 26 on the first end 19 of the stop rod 16. A suitable length of tubing 28 is secured between the weld nut 26 and the hex nut 25, the hex nut 25 acting as a jam nut. Thus, the first end 19 of the stop rod 16 is provided with minor and major diameters above and below the hex nut 25, respectively.

Referring now to FIG. 7, the aperture 17 is further illustrated. The aperture 17 comprises small and large diameter circular openings 30 and 31, respectively, interconnected by a slot 32 having parallel sides equal to the diameter of the small circular opening 30. The small and large diameter openings 30 and 31 are provided with diameters slightly larger than the minor and major diameters, respectively, of the first end 19 of stop rod 16. The openings 30 and 31 are defined by circles which would slightly intersect even without the provision of the slot 32. For example, when the small hole 30 is 13/32 of an inch in diameter and the large hole 31 is ¾ of an inch in diameter, the dimension L defining the maximum width of the aperture 17 is 1.12 inches. As indicated by dotted lines 33, the large circular opening 31 is provided with a suitable chamfer which in the case of a ¾ inch in diameter hole in 11 gauge (0.120 in.) sheet steel is a 1/16 × 45° chamfer.

The aperture 17 is disposed in the channel-shaped beam 7 that extends between the beams 5 of the stand 1. As best illustrated in FIG. 7, the large opening 31 of the aperture 17 is flush to one side 36 of the channel-shaped beam 7. The small opening 30 and the large opening 31 of the aperture 17 are centered on a centerline 37 which is tranversely centered on stand 1 and orthogonal to the axis of rotation 3 of the tilting rack 2. Since it is desirable to chamfer the lower edge of the opening 31 and it is also desirable to have the opening 31 flush with the inside surface of the side member 36 of the channel-shaped beam 7, first the aperture 17 is cut, drilled or otherwise formed in a flat piece of sheet steel, second the opening 31 is chamfered and then third the sides of the channel-shaped support member are formed on suitable sheet metal bending apparatus.

FIGS. 1, 5 and 6 illustrate the first end 19 of the pivoting stop rod 16 engaging the aperture 17 in a manner that latches the stacking table 11 in the horizontal working position illustrated in FIG. 1. Latching of the stacking table in this position is achieved by applying downward force on the handle 21 sufficient to horizontally center the stacking table 11 and pivot the stop rod 16 counterclockwise, in FIG. 1, positioning the first end 19 of the stop rod 16 in the small opening 30 of aperture 17 with the shoulder 21 engaging the underside of the opening 30. With the shoulder 21 secured under the small opening 30 of aperture 17, any free play in the horizontal stacking table 11 may be adjusted out with stop member 40 which is best illustrated in FIGS. 1 and 8.

Figure 8:
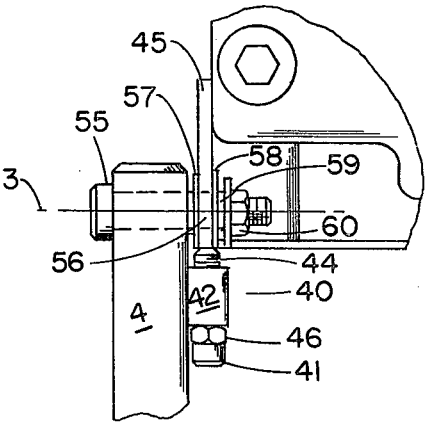
FIG. 8 is a rear view of the pivot point for the tiltable rack.

Referring now to FIGS. 8 and 9, the stop member 40 is illustrated as a bolt 41 threaded into a boss 42 which is welded or otherwise secured to one of the two vertical beams 4 forming a portion of the stand 1. The end 44 of the bolt 41 engages the underside of a sideplate 45 of the tiltable rack 2 at a point spaced from the axis of rotation to provide a horizontal stop against which the tilting rack 2 may be secured by the pivoting stop rod 16. Once the correct horizontal positioning is achieved, a jam nut 46 secures the bolt 41 in the desired position. As best illustrated in FIGS. 3 and 4, a pair of stop members 40 are provided on both vertical beams 4 of the stand 1.

Referring now to FIG. 2, the padding press is illustrated in the tilted or stacking position. When it is desirable to place the tiltable rack 2 in the stacking position, the user provides sufficient upward force on handle 21 of stop rod 16 to pivot the stop rod 16 clockwise. Referring now also to FIGS. 5 and 7, this clockwise movement disposes the first end 19 of stop rod 16 into the large opening 31 of aperture 17. Since the pivot point 18 of stop rod 16 is in the same vertical plane as the centerline 37 of openings 30 and 31 of aperture 17, pivoting of the stop 16 in a clockwise direction brings the major diameter of the first end 19 of stop rod 16 flush and into contact with the inside wall of side 36 of channel-shaped beam 7. Since the major diameter of the first end 19 of stop rod 16 is slightly smaller than the large opening 31 of aperture 17, further force on the handle 21 sufficient to rotate the tiltable rack 2 causes the major diameter of the first end 19 of the stop rod 16 to rise in opening 31. Thus, sufficient force to overcome any off center loading due to a stack of pads, such as the one illustrated at 48 in FIG. 2, rotates the tiltable rack 2 clockwise drawing the first end 19 of stop rod 16 up until the second shoulder 22 formed by the weld nut 26 abuts the lower surface of the channel-shaped beam 7. Once this stacking position is achieved, the center of gravity 50 of the tiltable rack 2 is sufficiently off center with respect to the axis of rotation 3 so that gravity secures the tiltable rack 2 in the stacking position illustrated in FIG. 2.

Referring now to FIG. 8, the construction of the axis of rotation or pivot point 3 of stand 1 is described in further detail. Disposed at the center of the axis of rotation 3 of stand 1 is a bolt 55 extending through the vertical beam 4 of stand 1. The bolt 55 extends through a hole 56 disposed in the side plate 45 of tiltable rack 2. Polished washers 57 and 58 abut opposite sides of the side plate 45 and the whole assembly is secured by lock washer 59 and a nut 60 on the end of bolt 55. Two such pivot points are provided on opposite sides of the stand 1 as best illustrated in FIGS. 3 and 4.

Referring now to FIG. 9, further details of the construction of tiltable rack 2 are illustrated. The basic structural member of tiltable rack 2 is a steel channel-shaped support member shown in cross section at 65 in FIG. 9. Side plates 45 which engage stops 40 are welded to the ends of channel 65. The planar stacking table 11, which is normally wood, is bolted to a pair of angle beams, such as the one illustrated at 66, that are welded at right angles to the channel 65. The upstanding tubular posts 12 are welded into the channel-shaped support member 65. A vertical rib 71 is welded to the posts 12 and the top and bottom of the channel 65. The upstanding posts 12 are disposed at a right angle to the table 11 on opposite sides of the table 11. FIG. 10 illustrates that the tops of upstanding posts 12 are tied together by a section of angle stock 72 with appropriate openings for insertion of the tops of posts 12. The tops of posts 12 are threaded so that threaded bushing 73 and 74 may be used to capture the angled section 72 on the tops of the upstanding posts 12.

Referring now to FIG. 4, illustrating a view of the padding press from the work area with the guide doors 13 opened, it may be seen that the upstanding posts 12 are a focal point in the structure of tilting rack 2 since both the movable means for guiding the stack of pads and the means for compressing the stack of pads are supported thereon. The means for compressing the stack of pads comprises a pair of pipe clamps 14 and a clamp bar 15. The pipe clamps 14 are vertically adjustable on the upstanding posts 12 when unloaded. However, when loaded by the thumb screws 80 on each clamp 14, the clamps 14 will securely grip the upstanding posts 12. Pressure generated by the thumb screws 80 forces the clamp bar 15 into clamping engagement with the stack of pads 48. The movable means for guiding the stack of pads comprises a pair of guide doors 13 which are hinged from upstanding posts 12 by first pairs of eye bolts 82 and 83 extending through the outside corners of both doors 13.

Referring now to FIG. 3, it is illustrated that both doors 13 are provided with handles 85 for manipulating the doors. Referring now to FIGS. 4, 9 and 10, the attachment of the eye bolts 82 and 83 to the upstanding posts 12 and the guide doors 13 is more clearly illustrated. Threaded shanks 86 of both first pairs of eye bolts extend through the doors 13 and perpendicular thereto. The shanks 86 of both first pairs of eye bolts 82 and 83 are secured to the doors by jam nuts 87, washers 88 and acorn nuts 90. The eyes 91 of both first pairs of eye bolts 82 and 83 encompass the upstanding posts 12 allowing both rotational and axial movement of the doors 13 about the upstanding posts 12. Axial movement of the doors 13 is limited by bushings at 95 secured by set screws at 96 to the tops of each upstanding posts 12. Referring now to FIGS. 4, 10, 11 and 12, means for latching the guide doors 13 in a closed position is illustrated.

The means for latching the guide doors comprises second pairs of eye bolts 98 and 99 disposed on the inside corners of each of the doors 13. The second pairs of eye bolts 98 and 99 cooperate with upper and lower latch posts 100 and 101, disposed on the top and bottom of tiltable rack 2, respectively. The upper latch posts are mounted on the angle stock 72 that interconnects the tops of upstanding posts 12. The lower latch posts are mounted on a horizontal support plate 102 which is welded to the vertical rib 71.

Referring specifically to FIGS. 11 and 12, the upstanding posts 100 are illustrated in more detail. Both the latch posts 100 and 101 are formed with allenhead bolts 105 secured in the angle stock 72 and support plate 102 by washers 107 and nuts 108. Referring specifically to FIGS. 9, 10 and 11, it is illustrated that both second pairs of eye bolts 98 and 99 are secured to the outside corners of the doors 13 by hex nuts 103, washers 104 and acorn nuts 105. The shanks of the second pairs of eye bolts extend perpendicular from the doors 13.

The doors 13 are secured to the latch posts 100 and 101 by simultaneously rotating the doors closed and lifting the doors by handles 85 so that the upper members of the first pair of eye bolts abut bushing 95. When the eye bolts 98 and 99 are then centered over latch posts 100 and 101, the user may release his grasp on handles 85 allowing eye bolts 98 and 99 to depend on latch posts 100 and 101. The doors 13 are then securely latched closed to provide a perfect, planar guide surface for the stack of pads 48.

Referring now to FIGS. 9 and 13, means for latching the doors in an open position is illustrated. The means for latching the doors in an open position is a pair of C-shaped stop members 110 which are welded to the top of the channel-shaped support member 65 which extends parallel to the axis of rotation 3 of tiltable rack 2. The C-shaped stop members 110 are disposed concentric to the base of each upstanding post 12 and are centered on an axis 111 parallel to the axis of rotation of tiltable rack 2. The stop members 110 are spaced from the posts 12 an amount sufficient to allow the lower members of the first pair of eye bolts to rest on the top surface of channel-shaped support member 65. Typically the C-shaped stop members 110 comprise a 130 degree circular section. To latch the doors 13 in the open position to the sides of the stacking table 11, the doors 13 are simultaneously rotated open and lifted by the handles 85 to cam the shanks 86 of the first pairs of eye bolts over and behind the C-shaped stop member 110. Once the shanks 86 are dropped behind the C-shaped stops 110, gravity securely latches the doors 13 to the sides of stacking table 11.

FIG. 9 also illustrates other details of the construction of tiltable rack 2. For example, it is illustrated that the pivoting stop rod 16 is pivoted to tiltable rack 2 by a yoke 115 welded to stop rod 16 and pinned by a nut and bolt 116 to a stop arm 117 welded to the center of channel-shaped support member 65. Channel-shaped support member 65 also supports two angular beams such as the one illustrated at 66 in FIG. 9 and FIG. 1. The beams 66 are disposed on opposite ends of the channel-shaped support member 65 and extend at right angles thereto. The beams 66 support the planar stacking table 11 which is bolted thereto. Referring now specifically to FIG. 1, it is illustrated that a second, smaller set of angular beams 121 are disposed on the ends of the beams 66 to serve as a rack for the clamp bar 13 when it is not in use. Referring now specifically to FIG. 9, it may be seen that the planar stacking table 11 abuts an angular stop member 130 extending parallel to the channel-shaped support member 65 and welded thereto. The angular stop member 130 serves also as an aligning surface for the guide doors 11.

OPERATION

In the operation of the padding press of the present invention, the user insures that the guide doors 13 are securely closed, and pulling upon the handle 21 he puts the press in the stacking position illustrated in FIG. 2. Once the pads or tablets 48 are aligned on the padding surface provided by the guide doors 13, the clamp bar 15 is placed above the stack of pads 48 and the pipe clamps 14 are applied to compress the pads between the bar 15 and the stacking table 11. The press may then be repositioned in the working position illustrated in FIG. 1 by applying downward pressure on the handle 21. The guide doors 13 are then latched in the open position by lifting and rotating the doors open with handles 85. This positions the doors 13 at the sides of the stacking table 11 as illustrated in FIG. 4. The press operator may then apply adhesive to the edges of the pads. Once the adhesive is secure, the pipe clamps 14 may be loosened, the clamp bar 15 removed and the pads 48 removed. The press is then ready for another padding operation.

Other forms, embodiments and applications of the invention may occur to those skilled in the art and it is intended by the appended claims to cover all such modifications coming within the proper scope of the invention.

The embodiments of the invention in which an exclusive property or privilege is claimed are defined as follows:

1. In a paper padding press, the combination comprising:

a support base;

a tiltable rack including a stacking table and movable means for guiding, said means for guiding disposed at a right angle to said stacking table;

means for applying compression to a stack of pads;

a stop rod having first and second ends, said stop rod being pivoted on said stacking table from a point on the underside of said stacking table; and an aperture in said support base below said stacking table for receiving said first end of said stop rod, said stop rod and said aperture cooperating to alternately latch said tiltable rack in a working position and gravity secure said tiltable rack in a stacking position without interference with said movable means for guiding.

2. The paper padding press of claim 1 further including first and second shoulders disposed on the first end of said stop rod, said first and second shoulders alternately engaging said aperture to fix said tiltable rack in stacking and working positions.

3. The paper padding press of claim 2 wherein said aperture comprises small and large diameter circular openings interconnected by a slot having parallel sides equal to the diameter of said small circular opening.

4. The paper padding press of claim 3 wherein said openings and said slot are centered on a centerline orthogonal to the axis of rotation of said tiltable rack and centered below said tiltable rack in a direction transverse to the axis of rotation of said tiltable rack.

5. The paper padding press of claim 3 wherein said support base includes a channel-shaped beam mounted to said support base below said stacking table parallel to the axis of rotation of said tiltable rack, said aperture being disposed in said channel-shaped beam and said large diameter circular opening being flush with one side of said channel-shaped beam.

6. The paper padding press of claim 3 wherein the end of said stop rod received in said aperture includes a minor and major diameter with said first shoulder disposed therebetween, said major diameter being disposed at the end of said stop rod and said second shoulder being disposed at the end thereof.

7. The paper padding press of claim 6 wherein said small and large diameter circular openings of said aperture are slightly larger than said minor and major diameters of said stop rod, respectively, said first shoulder engaging the underside of said small circular opening to latch said tiltable rack in the working position and said second shoulder engaging the underside of said large circular opening to gravity secure said tiltable rack in the stacking position.

8. The paper padding press of claim 1 wherein the second end of said stop rod is disposed at approximately a right angle to the end of said stop rod received by said aperture, said second end including a handle extending under said stacking table for pivoting said stop rod and thereby latching or unlatching said tiltable rack.

9. The paper padding press of claim 1 wherein said tiltable rack includes a pair of upstanding tubular posts disposed at a right angle to said stacking table said means for guiding and said means for applying compression being mounted thereon.

10. The paper padding press of claim 9 wherein said means for applying compression comprises:

a clamp bar extending between said upstanding tubular posts, said clamp bar being adjustable in a generally vertical direction for clamping a variable number of pads between said stacking table and said clamp bar; and a pair of pipe clamps one pipe clamp disposed on each upstanding tubular post, said pipe clamps being slidably adjustable along said upstanding tubular posts for urging said clamp bar into clamping engagement with the pads disposed thereunder.

11. The paper padding press of claim 9 wherein said means for guiding comprises a pair of guide doors, one guide door hinged to each upstanding tubular post.

12. The paper padding press of claim 11 further including means for latching said guide doors open and disposed to the sides of said stacking table, whereby access to the edges of pads stacked on said stacking table is provided for gluing said pads when said tiltable rack is in the working position.

13. The paper padding press of claim 12 wherein said means for latching said guide doors open comprises:

a pair of axially adjustable hinges on each guide door, said hinges comprising a first pair of eye bolts having shanks extending from each guide door, said first pair of eye bolts encompassing one of said upstanding tubular posts; and a pair of arcuate C-shaped stop members, said C-shaped stops being disposed one each at the base of each upstanding tubular post under the shanks of said first pair of eye bolts, whereby said guide doors may be latched to the side of said stacking table by pivoting and axial movement of said guide door which cams the shanks of said first pair of eye bolts over and behind said C-shaped stops.

14. The paper padding press of claim 11 further including means for latching said guide doors closed in a plane orthogonal to and extending vertically from said stacking table, whereby pads of paper may be stacked abutting said guide doors when said tiltable rack is in the stacking position.

15. The paper padding press of claim 14 wherein said means for latching said guide doors closed comprises:

a pair of axially adjustable hinges on each guide door;

a second pair of eye bolts extending from each guide door; and a pair of generally vertical upstanding latch posts disposed on said tiltable rack said second pair of eye bolts being pinned or unpinned on said latch posts by pivoting and axial movement of said guide door about said axially adjustable hinges.

16. The paper padding press of claim 1 further including an adjustable stop threaded into said supporting base and extending upward abutting the underside of said stacking table for adjusting the working position of said stacking table.

17. In a paper padding press of the type having a supporting base, a tiltable rack, movable means for guiding a stack of pads and means for applying compression to a stack of pads, the improvement comprising:

a stop rod having first and second ends, said stop rod being pivoted to the underside of said tiltable rack;

said first end of said stop rod including first and second shoulders; and an aperture in said supporting base, said aperture comprising interconnected small and large diameter openings, said aperture receiving said first end of said stop rod, said first and second shoulders alternately engaging said small and large openings, respectively, for latching said tiltable table in a working position or gravity securing said tiltable rack in a stacking position, respectively, without interfering with said movable means for guiding.

18. The paper padding press of claim 17 wherein said tiltable rack includes a pair of upstanding posts disposed at a right angle to a planar stacking table.

19. The paper padding press of claim 18 wherein said movable means for guiding comprises:

a pair of generally upstanding guide doors, one door hinged to each of said upstanding posts;

means for latching said guide doors in a closed position to provide a surface for aligning a stack of pads when said tiltable rack is in the stacking position; and means for latching said guide doors in an open position to provide access to the edges of the stacked pads for gluing.

20. The paper padding press of claim 19 wherein said means for applying compression to a stack of pads comprises:

a clamp bar vertically adjustable between said upstanding posts; and a pair of pipe clamps, one pipe clamp disposed on each upstanding post for urging said clamp bar into engagement with a stack of pads on said stacking table.

* * * * *